United States Patent [19]

Fukushima et al.

[11] Patent Number: 4,913,406

[45] Date of Patent: Apr. 3, 1990

[54] SHAFT FURNACE HAVING MEANS FOR CHARGING AND ADJUSTING A PRE-MIXTURE OF ORE AND COKE

[75] Inventors: Norio Fukushima, Tokyo; Yasunori Serizawa, Okayama; Kazuhiko Yoshida, Okayama; Shigeyasu Suzuki, Okayama; Masanobu Masukawa, Okayama; Shoji Sakurai, Okayama, all of Japan

[73] Assignee: Kawasaki Steel Corp., Japan

[21] Appl. No.: 89,602

[22] Filed: Aug. 25, 1987

[30] Foreign Application Priority Data

Aug. 26, 1986 [JP] Japan ..... 61-198238
Aug. 26, 1986 [JP] Japan ..... 61-198239

[51] Int. Cl.[4] ..... C22B 7/24

[52] U.S. Cl. ..... 266/92; 266/176; 75/469; 414/161

[58] Field of Search ..... 266/176, 92; 75/41, 75/42; 414/161, 199

[56] References Cited

U.S. PATENT DOCUMENTS 3,799,368 3/1974 Wieczorek ..... 266/176
4,361,315 11/1982 Kajihara et al. ..... 266/87
4,599,028 7/1986 Mahr et al. ..... 266/176

*Primary Examiner*—Melvyn J. Andrews
*Attorney, Agent, or Firm*—Austin R. Miller

[57] ABSTRACT

A method for operating a shaft furnace is performed by charging different ore/coke ratio mixture in radially different positions in the furnace. The ore/coke mixture ratio may be determined according to desired heat distribution in radial direction. For this, at least two mutually independently determined ore/coke mixture ratio mixtures are provided in each charge cycle of the burden. The mixture to be charged in the central portion of the furnace may have a higher coke content or a lower ore content for better permeability to the heating gas.

15 Claims, 7 Drawing Sheets

SHAFT FURNACE HAVING MEANS FOR CHARGING AND ADJUSTING A PRE-MIXTURE OF ORE AND COKE

BACKGROUND OF THE INVENTION

1. Field of the Invention

The present invention relates generally to a novel method for operating a shaft furnace for smelting pig iron, ferro alloy and so forth. More specifically, the invention relates to a method for operating a shaft furnace which is operable by charging mixture of ore and coke.

2. Description of the Background Art

Japanese Patent First (unexamined) Publication Showa 55-79810, published on June 16, 1980, discloses a method for operating a blast furnace, which method includes the steps of charging of mixture of ore and coke. This method is intended to make heating gas distribution in the radial directions uniform so as to assure reaction of the burden to the heating gas at different radial positions in the furnace. This method can realize more efficient reductive reactions and more effective heat exchange between the burden and reductive gas (CO gas and $H_2$ gas) than the traditional operation method of the furnace, in which ore and coke are alternatively charged for forming alternative ore and core layers.

However, in the prior proposed method which will be hereafter referred to as "perfectly mixed charging," a difficulty has been encountered in successfully providing a stable gas path for conveying the heating gas to the central portion of the furnace. In practice, the heating gas blown into the lower portion of the hot blast furnace through tuyeres forms an annular race way along the side wall of the furnace. The high temperature gas from this race way tends to flow upwardly essentially along the side wall of the furnace if there are not any stable gas path at the central portion of the furnace.

Generally, the gas flow path area is determined depending upon the grain size of the burden in the furnace. Namely, a larger grain size burden will provide a wider gas flow path and smaller grain size burden will provide a narrower gas flow path. In other words, larger grain size burden has lower gas flow resistance and thus has high gas permeability and smaller grain size burden has higher gas flow resistance and thus has lower gas permeability. On the other hand, in general, the grain size of the coke is much greater than that of ore. Therefore, the gas flow resistance of the ore is much higher than that of coke. In cases where the ore and coke mixture is the furnace burden, a higher ratio ore to coke will increase the gas flow resistance in the furnace. In other words, permeability may be improved by lowering the ratio of ore versus coke.

In the perfectly mixed change operation, effective reduction of ore can be expected. On the other hand, good operational methods have not found for control gas permeability in the furnace in order to get stable has been path. Namely, it is necessary to make the permeable portion for gas and melts in the furnace. Through experiences of blast furnace operation, it has been known that it is good to make the most permeable zone at the center portion of the furnace in order to achieve smooth furnace operation and protection of the furnace lining refractories. In the case of the perfectly mixed charge operation, the operational policy is the same. To realize the best operation in the perfectly mixed charge operation, the optimum strength of the central gas flow is necessary. However, good ideas annd operation practices for gas distribution control have not been found in the case of perfectly mixed charging operation.

As will be appreciated herefrom, the prior proposed method is not successful in providing stability in operating the furnace and cannot achieve the desired gas utilization rate and thus cannot achieve the desired operation efficiency.

SUMMARY OF THE INVENTION

Therefore, it is an object of the present invention to provide a novel and useful method of operation of a shaft furnace, which can solve the problems set out above.

Another object of the invention is to provide a shaft furnace operating method, which can provide satisfactory and optimum gas flow distribution in the radial direction.

In order to accomplish the aforementioned and other objects, a method for operating a shaft furnace, according to the present invention, is performed by charging a different ore/coke ratio mixture in radially different positions in the furnace. The ore/coke mixture ratio may be determined according to desired gas distribution in the radial direction.

In practice, at least two mutually independently determined ore/coke mixture ratio mixtures are provided in each charge cycle of the burden. The mixture to be charged in the central portion of the furnace may have a higher coke content or a lower ore content for better permeability of gas and melt.

According to one aspect of the invention, a method for performing a smelting operation comprises the steps of:

supplying ore and coke for preparing a pre-mixture to charge in a shaft furnace;

charging the pre-mixture of the ore and coke to the shaft furnace;

introducing a heating gas through tuyeres for heating the burden in the shaft furnace for obtaining molten pig metal; and adjusting the mixture ratio of the ore and coke so that the ore/coke mixture ratio in the central portion of the furnace is different from that in the circumferential portion of the furnace.

In the method, as set forth above, the ore/coke mixture ratios at the central portion and the circumferential portion are so adjusted as to provide lower gas flow resistance at the central portion of the furnace in comparison with that in the circumferential portion. The ore/coke mixture ratios at the central portion and the circumferential portion may be so adjusted to provide greater gas flow amount in the central portion than that in the circumferential portion. If desired, the mixture to be charged in the central portion can have coke rate of 100%.

In the preferred embodiment, the method set forth above further comprises the steps of monitoring gas flow distribution over the radial positions in the furnace and adjusting the ore/coke ratios in the central portion and the circumferential portion to maintain the gas flow distribution at a predetermined pattern. The adjustment of the mixture ratios includes adjustment of the areas to distribute the different ore/coke ratios of mixtures. This adjustment of the mixtures distribution areas can be performed for minimizing the area around the center of the furnace where the mixture providing lower gas flow resistance is charged. The adjustment of the mixtures distribution areas may also be performed for providing lower gas flow resistance in the region adjacent a furnace wall than that of remainders in the circumferential portion.

According to another aspect of the invention, a method for performing a smelting operation comprises the steps of:

preparing a first mixture of ore and coke to charge in a shaft furnace, which provide first gas flow efficiency for a heating gas;

preparing a second mixture of ore and coke to charge in a shaft furnace, which provide second gas flow efficiency for the heating gas, which second gas flow efficiency is lower than the first gas flow efficiency;

charging the first mixture of the ore and coke to the central portion of the shaft furnace; and charging the second mixture of the ore and coke to the circumferential portion of the shaft furnace.

In the method set forth above, distribution of the first mixture in the central portion and the second mixture in the circumferential portion is so adjusted as to maintain the gas flow pattern over radially oriented various positions in the furnace in conformance with a predetermined distribution pattern. The distribution of the first and second mixture is so adjusted as to provide predetermined first gas flow efficiency which, in other words means, permeability of the mixture, at the center of the furnace, which predetermined gas flow efficiency at the center of the furnace is higher than that of the remainder and is determined for providing enough heat value necessary for smelting operation. The predetermined gas flow efficiency in the center of the furnace is determined at a possible minimum value for providing possible minimum heat value which is enough to effectively perform a smelting operation. That is, the target gas distribution pattern is so determined as to establish the most optimum operation which includes smooth burden descending, stable blast pressure and good gas utilization. The optimum operation is dependent upon the strength of center gas flow. That is, the stronger the central gas flow becomes, the more stable the operation becomes, but the worse the top utilization becomes. Accordingly, the distribution of the first and second mixture is so adjusted as to provide the minimum intensity of central gas flow to obtain smooth operation.

Preferably, the method set forth above further comprises steps of monitoring gas flow distribution in the furnace during smelting operation and adjusting radial positions to charge the first and second mixtures for maintaining the gas flow pattern in conformance with the predetermined pattern. The distribution of the first and second mixture is so adjusted as to provide higher gas flow efficiency for the portion adjacent the furnace wall than that in the general portion, which gas flow efficiency in the portion adjacent the furnace wall is determined to be sufficient for preventing melt fro adhering onto the furnace wall.

On other hand, the the gas flow efficiencies of the first and second mixtures are determined depending upon mixture rate of coke versus ore, and coke ratio versus ore in the first mixture is higher than that in the second mixture. The ore/coke mixture ratios of the first and second mixtures are variable for maintaining gas flow pattern over radially oriented various positions in the furnace in conformance with a predetermined distribution pattern.

In addition, the method further comprises steps of monitoring gas flow distribution in the furnace during smelting operation and adjusting one of the distributing positions of the first and second mixtures and the mixture ratios of the first and second mixtures for maintaining the gas flow pattern in conformance with the predetermined pattern.

According to a further aspect of the invention, a system for a smelting operation comprises first means for supplying ore and coke for preparing a pre-mixture to charge in a shaft furnace, second means for charging the pre-mixture of the ore and coke to the shaft furnace, third means for introducing a heating gas through tuyeres for heating the burden in the shaft furnace for obtaining molten pig metal, and fourth means for adjusting the mixture ratio of the ore and coke so that the ore/coke mixture ratio in the central portion of the furnace is different from that in the circumferential portion of the furnace.

In the preferred construction, the first means adjusts the ore/coke mixture ratios to charge in the central portion and the circumferential portion are so as to provide lower gas flow resistance for greater gas flow amount at the central portion of the furnace in comparison with that in the circumferential portion. The first means also adjusts the ore/coke ratios to provide greater gas flow amount in the portion adjacent a furnace wall than that in the remainder of the circumferential portion.

The system may further comprise fifth means for monitoring gas flow distribution over the radial positions in the furnace and the first means is controlled operation on the basis of the monitored gas distribution for adjusting the ore/coke ratios in the central portion and the circumferential portion to maintain the gas flow distribution at a predetermined pattern. The second means is operative for adjusting the areas to distribute the different ore/coke ratios of mixtures. The second means performs adjustment of the mixtures distribution areas for minimizing the area around the center of the furnace where the mixture providing lower gas flow resistance is charged with maintaining necessary gas flow amount required for effectively performing smelting operation. The second means also performs adjustment of the mixtures distribution areas for providing lower gas flow resistance in the region adjacent a furnace wall than that of remainders in the circumferential portion.

According to a still further aspect, a system for performing a smelting operation comprises a first mixture supply means for preparing a first mixture of ore and coke to charge in a shaft furnace, which provide first gas flow efficiency for a heating gas, second mixture supply means for preparing a second mixture of ore and coke to charge in a shaft furnace, which provide second gas flow efficiency for the heating gas, which second gas flow efficiency is lower than the first gas flow efficiency, third mixture charge means for charging the first mixture of the ore and coke to the central portion of the shaft furnace, and fourth mixture charge means for charging the second mixture of the ore and coke to the circumferential portion of the shaft furnace.

In the preferred construction, the third and fourth means distributes the first mixture in a first position in the central portion and the second mixture in a second position in the circumferential portion so as to maintain gas flow pattern over radially oriented various positions in the furnace in conformance with a predetermined distribution pattern. The third and fourth means distributed the first mixture in a first position in the central portion and the second mixture in a second position in the circumferential portion so as to provide predetermined gas flow efficiency at the center of the furnace, which predetermined gas flow efficiency at the center of the furnace is higher than that of the remainder and is determined for providing enough heat value necessary for smelting operation. The predetermined gas flow efficiency in the center of the furnace is determined at a possible minimum value for providing possible minimum heat value which is enough to effectively perform the smelting operation.

The system may further comprise fifth means for monitoring gas flow distribution in the furnace during smelting operation and producing gas flow distribution indicative signals and sixth means receiving the gas flow distribution indicative signals for detecting gas flow pattern, comparing the detecting gas flow pattern with the gas flow pattern, the deriving radial positions to distribute the first and second mixtures, and outputting distribution control signals for the third and fourth means for radially adjusting the first and second positions to charge the first and second mixtures for maintaining the gas flow pattern in conformance with the predetermined pattern. The sixth means also derives distribution of the first and second mixture and is so adjusted as to provide higher gas flow efficiency for the portion adjacent the furnace wall than that in the general portion, which gas flow efficiency in the portion adjacent the furnace wall is determined to be sufficient for preventing melt from adhering onto the furnace wall. The first and second mixture supply means are operative for adjusting gas flow efficiencies of the first and second mixtures, and the sixth means being operative for determining ore/coke mixture ratios on the basis of the gas flow distribution indicative signal to produce mixture control signal to control operations of the first and second mixture supply means for adjusting mixture rate of coke versus ore, in which the sixth means operates the first mixture supply means for preparing the first mixture having coke ratio versus ore higher than that in the second mixture.

Also in this system, the coke ratio in the first mixture can be 100%.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
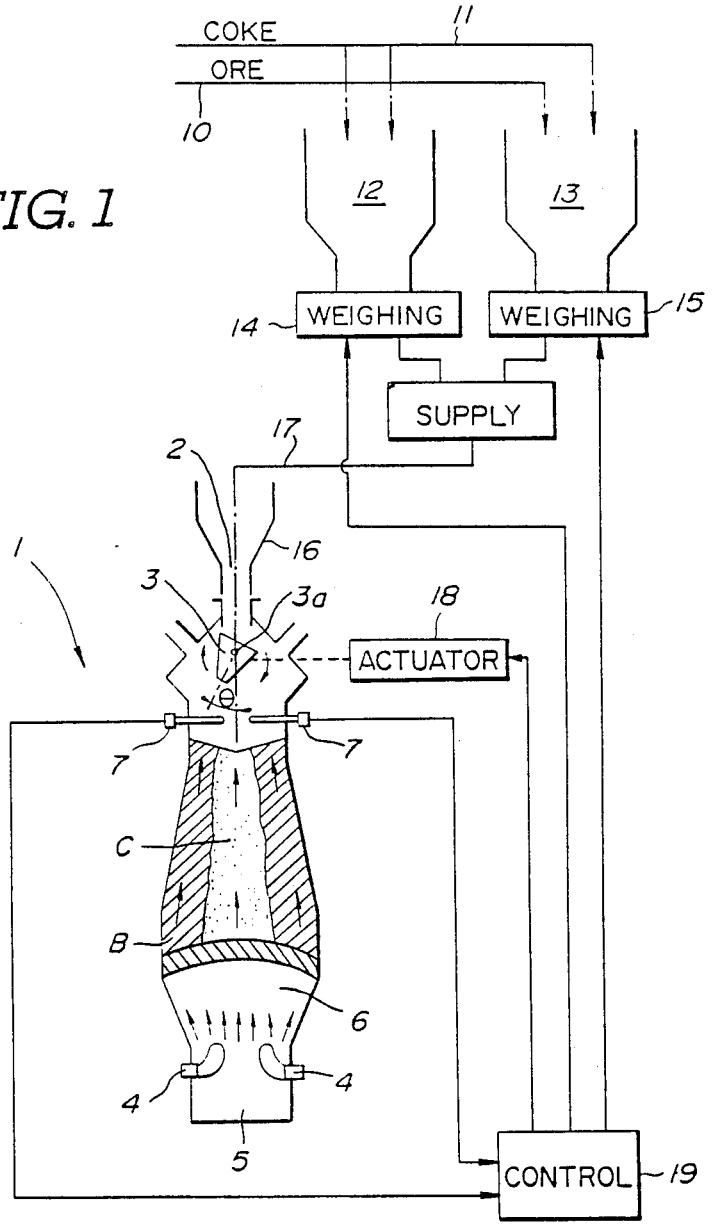
FIG. 1 is an explanatory illustrated section of a shaft furnace, about which the preferred embodiment of the operating method is performed.

Referring now to the drawings, particularly to FIG. 1, there is shown a shaft furnace 1 for smelting pig iron, ferro aloy, such as ferro manganese and so forth. As is well known, the furnace 1 has buncker openings 2 at the top thereof. A distribution chute 3 is located immediately below the charge opening 2. The distribution chute 3 is pivotably supported by means of a support pin 3*a* for varying the inclination angle and for rotation. The distribution chute 3 can circumferentially distribute a burden charged through the top bunker 2.

As is well known, charge operation for the furnace 1 is performed cyclically or intermittently at given intervals. In each charge cycle which is called a "batch", a predetermined amount of ore and coke are charged. Therefore, in the furnace, a plurality of burden layers which are charged in different batch cycles, are formed. The burden in the furance is heated by heating gas generated in a hot stove (not shown) and introduced through tuyeres 4 provided at lower portion of the furnace 1. In general, due to the high temperature of the introduced heating gas, the coke is combusted to generate heat for melting the ore for forming molten pig iron or molten ferro alloy. Such molten pig iron or molten ferro alloy flows downwardly to a hearth 5 of the furnace via a bosh 6. On the other hand, by reaction of the heating gas and ore and/or coke, CO gas and $H_2$ gas are generated. These gases flow through gaps formed between individual ores and cokes.

In the preferred embodiment, the ore and coke are charged in a form of a mixture. As diagramatically illustrated in FIG. 1, the ore and the coke are conveyed by a ore/coke mixture supply system which includes conveyer systems 10 and 11 in per se well known manner and stocked in hoppers 12 and 13. weighing devices 14 and 15 are associated with the hoppers 12 and 13 for adjusting the amount of the ore and the coke respectively. The weighed ore and coke are conveyed to a charge hopper 16 which is provided immediately above the charge opening 2, by means of a conveyer 17.

Figure 4:
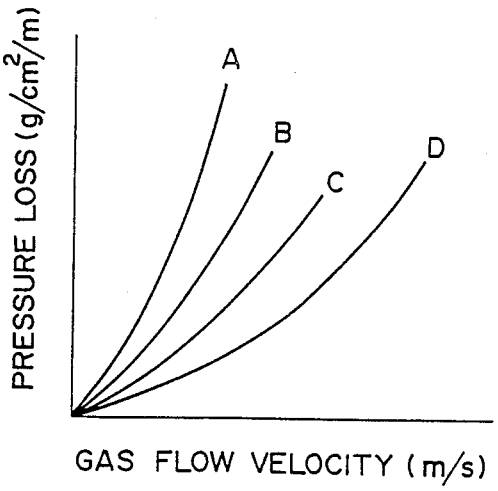
FIG. 4 is a graph showing pressure drop in each section of the furnace, relative to the gas flow velocity.

Here, flow resistance of ore and coke for the gases, which causes pressure drop of the gases, is shown in FIG. 4. In FIG. 4, the curve A represents pressure loss (g/cm$^{2/m}$) in ore and the curve D represents pressure drop in coke, relative to the gas flow velocity (m/sec.). As set forth above, since the average grain size of the ore is much smaller than that of the coke, the gas flow resistance pr permeability of the ore charged in the furnace 1 is much higher than that of the coke because a smaller gas flow gap can be formed. In FIG. 4, the curves B and C represent pressure drops of different ore/coke ratio mixture rates of mixtures. As clear from the foregoing discussion, the mixture causing the pressure drop in the gas as illustrated by the curve B has a greater ore content than that represented by the curve C.

In theory it is desirable to maintain the burden heating efficiency uniform throughout every radial section in the furnace. This can be achieved by providing a uniform amount of heating gas to every section in the furnace. However, providing uniform gas flow at every section in the furnace is not practically possible. Experience shows that it is practically desirable to provide a higher gas flow efficiency with higher gas permeability for flowing greater amount of reductive gas in the central portion of the furnace in comparison with that in the circumferential portion, so as to obtain a sufficient amount of calories to adequately heat the burden in the furnace. On the other hand, by providing a higher gas flow efficiency in the central portion, certain amount may escape therethrough to lower heating efficiency. The wasted amount of the heating gas is generally represented by difference of gas flow amount between the central portion and the circumferential portion. In view of this, the peak value of the gas flow amount which is obtained at the central portion, has to be minimized in relation to the gas flow amount in the circumferential portion of the furnace.

Figure 2:
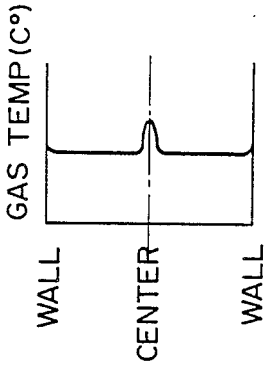
FIG. 2 is a graph showing gas temperature distribution in the furnace while the preferred embodiment of the operating method for operation of the furnace is performed.
Figure 3:
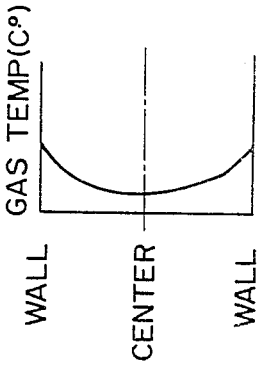
FIG. 3 is a graph showing gas temperature distribution in the furnace when a uniform ore/coke mixture is charged.

On the other hand, FIG. 2 illustrates a desirable gas temperature distribution in radial directions in the furnace in view of the efficiency of the smelting operation. Namely, the gas temperature is variable depending upon the gas flow efficiency in various positions in the furnace. Therefore, the higher gas temperature represents lower gas flow resistance and higher gas flow efficiency. In the desirable gas temperature distribution, the gas temperature at the central position of the furnace is higher than that in the circumferential portion close to the side wall of the furnace. On the other hand, a slightly higher gas temperature which is lower than the gas temperature in the central portion but higher than the general section of the circumferential portion, is preferred at the the outermost region of the circumferential portion. Slightly higher gas flow efficiency at the outermost circumferential region may successfully prevent the melt generated in the melting operation from adhering to the furnace wall. When a uniform ore/coke distribution ratio of mixture is charged throughout every radial position of the furnace, the gas temperature distribution becomes as that illustrated in FIG. 3. As seen from FIG. 3, the gas temperature at the central portion tends to be lower than that of the circumferential portion in this case. This is caused by uneven grain distribution of the charged mixture in the furnace. Namely, the smaller grain size ore and coke tend to be concentrated at the central portion of the furnace though the ore/coke mixture ratio is uniform over the furnace. A smaller grain size mixture at the central portion creates smaller gas flow gaps and causes greater pressure drop of the gas. On the other hand, it tends to occur that a zone which has substantially high permeability, is formed in the furnace to allow escape of the reactive gas. Such high permeably zone tends to fluctuate between each operation cycle. Because the gas flooding may easily occur through such highly permeable zone or zones due to fluctuation of the grain size segregation. In case of charging one kind of mixture, gas distribution control becomes difficult. Therefore, when uniform ore/coke mixture is to be charged throughout every radial position in the furnace, the grain sizes of the ore and coke have to be carefully controlled for maintaining sufficiently high gas flow efficiency. Even when the grain sizes of the ore and coke is sucessfully controlled to form the uniform mixture, the gas temperature distribution may still maintain the distribution pattern of FIG. 3.

In order to achieve the desired gas temperature distribution in the furnace as shown in FIG. 2, different mixture ratios of ore/coke mixtures are charged at radially different positions in the furnace. Namely, in order to obtain higher gas temperature at the central portion, the coke content in the mixture to be charged into the central portion is generally set higher than that to be charged in the circumferential portion.

Figure 5:
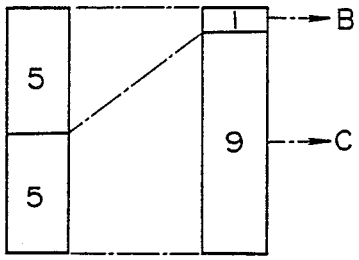
FIGS. 5(A) and 5(B) show examples of ore/coke ratio to be utilized in the preferred embodiment of the furnace operating method according to the invention.
Figure 5:
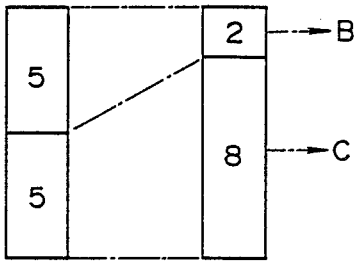

FIGS. 5(A) and 5(B) illustrate examples of the ore/coke mixture ratio utilized for performing the preferred embodiment of the operation method for the furnace, according to the invention. In both examples, it is assumed that 10 tons or ore and 10 tons of coke are to be charged in each batch cycle for one charge. In the example of the FIG. 5(A), a mixture B to be charged in the circumferential portion of the furnace as shown in FIG. 1, is formed by mixing 5 tons of ore and 1 ton of coke. On the other hand, a mixture C to be charged in the central portion of the furnace as shown in FIG. 1, is formed by mixing 5 tons of ore and 9 tons of coke. On the other hand, in the example of FIG. 5(B), a mixture B to be charged in the circumferential portion of the furnace as shown in FIG. 1, is formed by mixing 5 tons of ore and 2 tons of coke. On the other hand, a mixture C to be chared in the central portion of the furnace as shown in FIG. 1, is formed by mixing 5 tons of ore and 8 tons of coke. In either case, the mixture C has lower gas flow resistance to causing lower pressure drop than that of the mixture B as shown in FIG. 4.

It should be appreciated that the examples of the ore/coke mixture ratio shown in FIGS. 5(A) and 5(B) are mere examples for facilitating better understanding of the invention. The number of different mixtures to be charged in each charge cycle is not necessarily just two but can be more than two. It may be possible to continuously vary the ore/coke mixture rate at various radial positions in the furnace. It should be also appreciated that the radius or diaweigh of the central portion where the mixture C is charged has to be minimized in view of maximization of heat exchanger effextiveness the ore/coke mixture as heated by the heating gas and by combustion of the coke.

Figure 6:
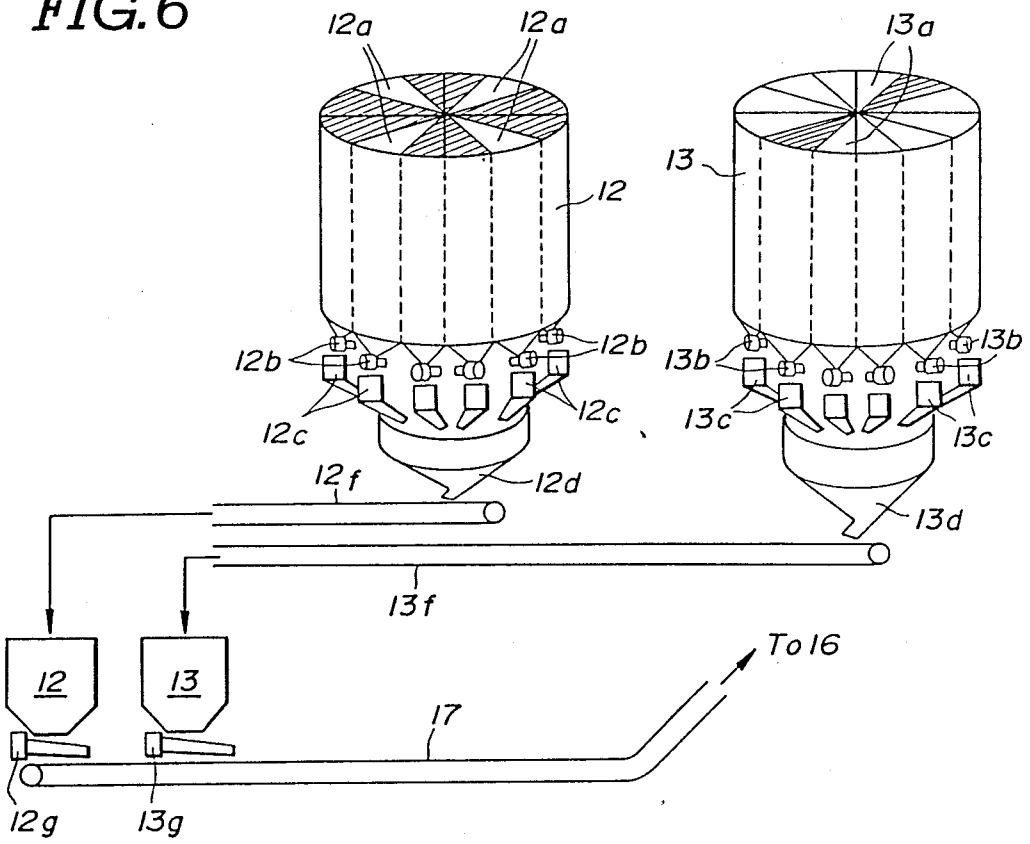
FIG. 6 is an explanatory illustration of the preferred construction of ore/coke mixture supply system to be employed in the preferred embodiment of the invention.

FIG. 6 shows the detail of the preferred construction of the ore/coke mixture supply system to be employed for implementation of the preferred embodiment of the furnace operation method according to the present invention. As will be seen from FIG. 6, two stock hoppers 12 and 13 are separated into a plurality of chambers 12*a* and 13*a* for respectively receiving ore and coke. In the shown example, the hopper 12 is designed for supplying the ore/coke micture C and the hopper 13 is designed for supplying the ore/coke mixture B. In order to easily obtain the desired ore/coke ratio, the hopper 12 is separated into fourteen individual chambers 12*a* for forming the mixture C of FIG. 5(A). Among the fourteen chambers 12*a*, five chambers are occupied by ore and remaining 9 are occupied by coke. Similarly, in order to form the mixture B of FIG. 5(A). the hopper 13 is separated into six individual chambers 13*a*, among which five chambrs are occupied by ore and one is occupied by coke. Feeder 12*b*, 13*b* and weighing hopper 12*c*, 13*c* are provided for each individual chamber 12*a* and 13*a* for weighing ore or coke in the associated chamber. The ore and coke weighed through the feeders 12*b* and 13*b* are fed to confluence hoppers 12*d* and 13*d* via the weighing hoppers 12*c* and 13*d*. These feeders 12*b*, 13*b*, the weighing hoppers 12*c*, 13*c* and the confluence hoppers 12*d*, 13*d* forms the weighing device 14 and 15.

It should be further appreciated that the number of chambers to be defined in the stock hoppers is not essential to the invention and can be varied at any numbers. For example, In order to easily obtain the desired ore/-coke ratio, the hopper 12 is separated into twelve individual chambers 12*a* for forming the mixture C of FIG. 5(A). Among the twelve chambers 12*a*, four chambers are occupied by ore and remaining eight are occupied by coke. Similarly, in order to form the mixture B of FIG. 5(A). the hopper 13 is separated into twelve individual chambers 13*a*, among which ten chambers are occupied by ore and two are occupied by coke.

The confluence hoppers 12*d* and 13*d* are connected to a surge hoppers 12*e* and 13*e* via belt conveyers 12*f* and 13*f*. The surge hoppers 12*e* and 13*e* are designed to supply the mixture to a charging conveyer 17 which carry the supplied mixture to the charge hopper 16.

In the practical charge operation, the weighing devices 14 and 15 are operated to weigh the ore and the coke for forming the predetermined mixtures B and C for one charge cycle. The weighed mixtures B and C are fed to the source hoppers 12*e* and 13*e*. The surge hoppers 12*e* and 13*e* are respectively associated with feeders 12*g* and 13*g* for feeding the mixture B and C at controlled timing in synchronism with the chute position. In each charge cycle, the inclination of the chute 3 is intermittently adjusted. At the initial position upon starting of the charge cycle, the chute is positioned at the greatest inclination angle $\theta$ for charging the mixture B at the outer most circumferential regions. The chute 3 is then turned about the vertical axis for circumferentially distributing the mixture. After one or more given cycles of turns, the inclination angle of the chute is reduced by a given value for distributing the mixture into the next region. By repeating this, the inclination angle of the chute 3 is cyclically or intermittently reduced to the predetermined minimum inclination angle for distributing the mixture to the central portion of the furnace. Therefore, through predetermined number of distribution cycles, the feeder 13*g* and conveyer 13*f* are activated to feed the mixture B in the surge hopper 13*e* to the charging conveyer 17. After completing the charging operation of the mixture B, the feeder 12*g* becomes active to feed the mixture C from the surge hopper 12*e* to the charging conveyer 17.

The inclination angle of the distribution chute 3 is adjusted by means of an actuator 18 to direct the charged mixture to the circumferential portion of the furnace. Then, the chute 3 is driven to rotate for distributing the mixture B throughout the circumferential portions of the furnace. Thereafter, the weighing amount to charge the mixture C, the inclination angle of the chute 3 is adjusted by the actuator 18 to direct the mixture C to the central portion of the furnace.

By charging the mixture B in the circumferential portion of the furnace, the gas flow resistance in the circumferential portion becomes greater than that in the central portion where the mixture C is charged.

In order to monitor the operating condition of the furnace, sondes or probes 7 are radially inserted into furnace 1 above the top of the burden. The sondes 7 employed in the shown embodiment are designed for measuring the gas temperature and for monitoring gas composition at various radially different positions in the furnace. The sondes 7 may produce temperature indicative signals and gas composition indicative signals and feed to a control board 19. Based on the gas temperature distribution in the furnace as monitored based on the gas temperature indicative signals from the sondes 7, the ore/coke mixture ratios in the mixtures B and C are adjusted. On the other hand, it is possible to adjust the proportion of the mixtures B and C for adjusting the gas temperature distribution.

In case the ore/coke mixture ratio of the mixtures B and C are to be adjusted, mixture rate control signals are fed to the weighing devices for adjusting the ore and coke weighing amount. On the other hand, in case, the proportion of the mixtures B and C are adjusted, the distribution control signal is fed to the actuator 18 for adjusting the inclination angle of the chute 3 according to the desired proportions of the mixtures B and C.

Figure 7A:
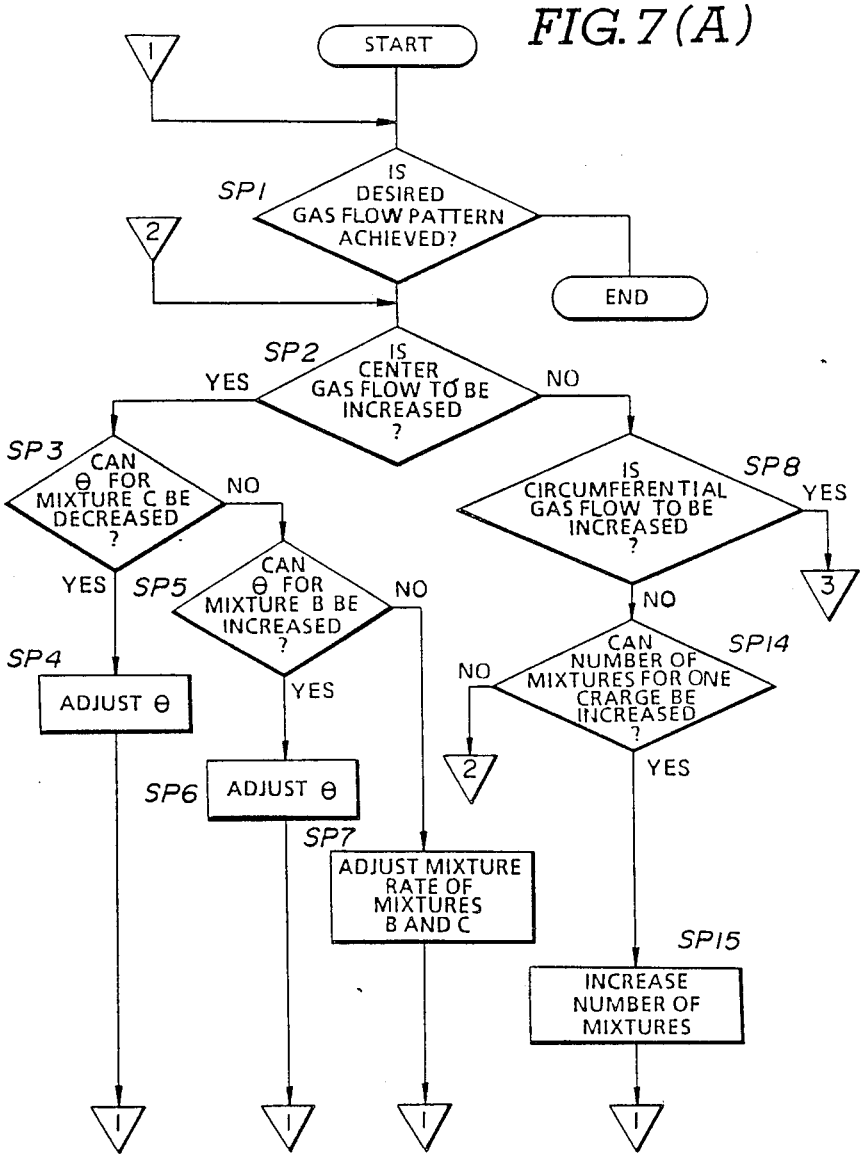
FIGS. 7(A) and 7(B) are a sequence of flowchart showing the preferred operation in implementing the preferred embodiment of the furnace operation method according to the invention.
Figure 7:
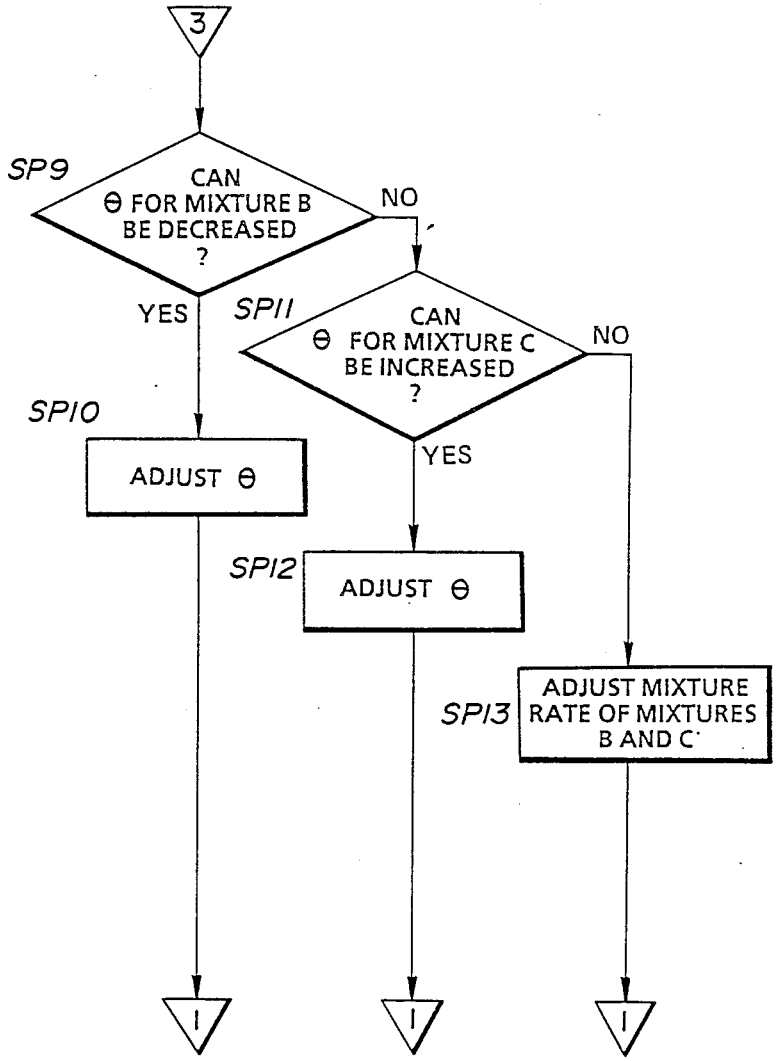

FIG. 7 shows a flowchart showing practical operation in implementation of the preferred method according to the invention. The shown operation is performed every four to eight hours, in practice. In normal case, the operation of the flowchart in FIG. 7 is performed every eight hours. Immediately after starting operation, the gas temperature distribution is checked at a step SP1. Checking of the gas temperature distribution may be performed by comparing the gas temperature data from the sonde 7 with a corresponding reference data representative of the target gas temperature distribution. When the difference between the gas temperature data and the reference data is within an acceptable range, operation goes end to maintain the present operating condition of the furnace. Therefore, the burden distribution, i.e. the ore/coke mixture rates in the mixtures B and C are held unchanged and proportion of the mixtures B and C is also unchanged.

On the other hand, when the difference of the gas temperature data and the reference data is out of the acceptable range, subsequent operations through steps 15 are performed for adjusting the ore/coke mixture rates and/or adjusting proportion of the mixtures B and C. At a step SP2, the gas temperature data indicative of the gas temperature at the center of the furnace is compared with the corresponding reference data in order to judge whether the gas flow efficiency in the center of the furnace has to be increased or not. When judgement is made that the gas flow efficiency in the central portion where the mixture C is charged, is to be increased, a check is performed at a step SP3 to determined whether the radius of the central portion to which the mixture C is to be charged can be reduced for concentrating the high gas flow efficiency region to the narrower area in which around the center of the furnace. In practice, the area to charge the mixture C is determined by varying the inclination pattern of the chute. Namely, the chute inclination angle is reduced for narrowing the the central area for raising the gas temperature at center of the furnace. Therefore, when the answer in the step SP3 is "YES", the inclination angle $\theta$ of the chute 3 is reduced at a step SP4. On the other hand, when the answer in the step SP3 is "NO", then a check is performed at a step SP5 whether the chute inclination pattern can be varied to distribute larger amount of the mixture B in the area close to the furnace wall. If the answer in the step SP5 is "YES", the chute inclination pattern is adjusted at a step SP6 to increase the amount of the mixture B to be distributed to the area close to the furnace wall. On the other hand, if the answer in the step SP5 is "NO", the ore/coke mixture ratios for the mixtures C and B are adjusted at a step SP7. In this case, the coke rate versus the ore in the mixture C is increased and the coke rate versus the ore in the mixture B is decreased. By adjusting the ore/coke ratio to increase the coke content of the mixture C, higher gas flow efficiency can be obtained.

On the other hand, when the gas flow efficiency at the center of the furnace is not to be increased, as checked in the step SP2, a check is performed at a step SP8 to determine whether the gas flow efficiency in the outermost circumferential portion is to be increased. If "YES", a further check is performed at a step SP9 whether chute inclination angle $\theta$ for distributing the mixture B can be reduced. If the aswer in the step SP9 is "YES", the chute inclination pattern is modified at a step SP10 for shifting the distributing area of the mixture B toward the center of the furnace. On the other hand, if the answer at the step SP9 is "NO", a further check is performed at a step SP11 whether distributing area of the mixture C can be expanded to expand the high gas flow rate section where the mixture C is charged. If the answer at the step SP11 is YES", the chute inclination angle for distributing the mixture C is increased to shift the distributing area of the mixture C toward the furnace wall, at a step SP12. On the other hand, when the answer in the step SP11 is "NO", then the ore/coke mixture ratios of the mixtures B and C are adjusted to reduce coke content of the mixture C and increase coke content or reduce ore content of the mixture B.

On the other hand, when the answer in the step SP8 is "NO", then adjustment of gas flow efficiency is performed for the intermediate portion between the outermost circumferential portion and the central portion. In this case, a check is performed at a step SP14 to determine whether the number of mixtures to be charged in one charge cycle can be increased. If "NO", the process returns to the step SP2. On the other hand, if "YES", one mixture which has ore/coke mixture ratio that is intermediate between the mixtures B and C is added, at a step SP15. The additional mixture is charged at the intermediate portion between the central portion where the mixture C is charged and the circumferential portion where the mixture B is charged.

As will be appreciated herefrom, since the higher permeability can be provided for the central portion of the furnace by charging the mixture C at the central portion of the furnace, the heating gas is more effectively distributed to more effectively use the CO gas and $H_2$ gas, which CO gas utilization rate can be calculated by $\{CO_2\%/(CO\%+CO_2\%)\}$ and $H_2$ gas utilization rate can be calculated by $\{H_2O\%/(H_2\%+H_2O\%)\}$. This makes the heat conversion of the gas and the reducing reaction in the furnace effective. Furthermore, varying the grain size of the mixture of the ore and coke will not so seriously affect the operating condition in the furnace. Therefore, precise grain size control for the ore and coke becomes unnecessary.

The following table shows gas consumption rate (%) and fuel efficiency (kg/ton) of the aforementioned preferred embodiment of the operation method and in the conventional operation method, in which the pure ore layers and pure coke layers are alternatively formed by charging the ore and coke separately.

TABLE

| | Blast Furnace | | Shaft Furnace for Ferro Alloy | |
|---|---|---|---|---|
| | Conventional | Invention | Conventional | Invention |
| Gas Utilizing Rate (%) | 50 | 52.5 | 9.8 | 10.5 |
| Fuel Efficiency (kg/ton) | 481 | 458 | 1520 | 1470 |

Figure 8:
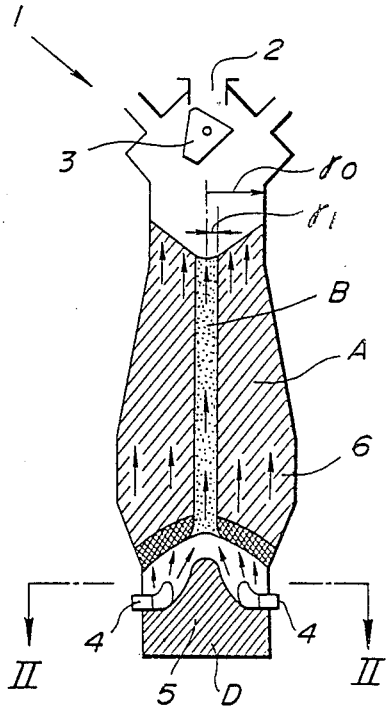
FIG. 8 is an explanatory illustrated section of a shaft furnace, in which a modified embodiment of the furnace operating method is to be performed.
Figure 9:
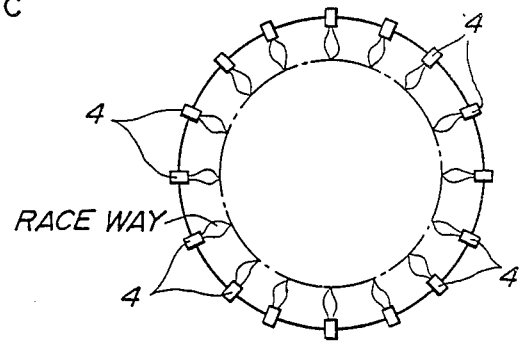
FIG. 9 is a explanatory section taken along line VII—VII of FIG. 8.

FIG. 8 shows another preferred embodiment of the operation method for the shaft furnace according to the invention. In this embodiment, the mixture of the ore and the coke is charged into the circumferential portion of the furnace and the pure coke is charged in the central portion of the furnace. By charging the pure coke into the central portion of the furnace, a coke pillar is formed along the center axis of the furnace. In this case, the radius $r_1$ of the central coke portion and the radius $(r_0-r_1)$ of the circumferential ore/coke mixture portion influences to the operation efficiency of the furnace.

Figure 11:
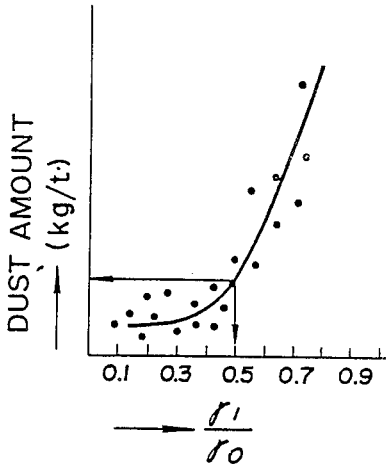
FIG. 11 is a graph showing the amount of dust of different ore/coke mixtures in relation to the ratio of diaweighs of the areas charged different ore/coke mixture ratios of mixtures.
Figure 10:
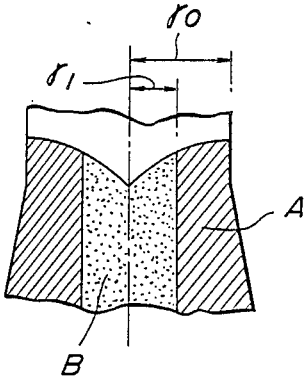
FIG. 10 is an enlarged section of the burden in the furnace, charged according to the modified method.
Figure 12:
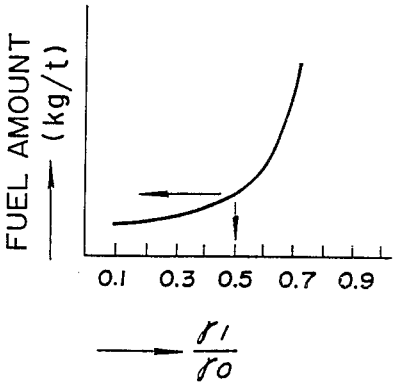
FIG. 12 is a fuel efficiency in relation to the ratio of diaweighs of different ore-coke ratio burdens.

As seen from FIGS. 11 and 12, the dust ratio (kg/ton) with the respect to the ratio of $r_1$ versus $r_0$ $(r_1r_0)$ and the fuel efficiency (kg/ton) in relation to the $(r_1/r_0)$ ratio are variable. When the $(r_1/r_0)$ ratio becomes greater than 0.5, the amount of dust generated relative to the amount of pig iron produced, becomes excessive. This makes the smelting operation uneconomical. Therefore, in view of this, the $(r_1/r_0)$ ratio is limited to be lower than or equal to 0.5. This also can be proven from the data in FIG. 12. As will be seen from FIG. 12, when the $(R_1/r_0)$ ratio becomes greater than 0.5, the consumed fuel amount versus the pig iron produced becomes unacceptably great.

As will be appreciated herefrom, even by this embodiment, high efficiency of furnace operation substantially similar to that obtained in the former embodiment can be obtained.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

For example, though the shown embodiment has been disclosed in terms of the furnace operation method for operating the furnace with mutually different ore/coke ratio of two mixtures, it would be possible to use more than two mutually different ore/coke ratios of mixtures. Utilizing greater number of mixtures, gas temperature distribution in radial direction of furnace can be more delicately controlled. Furthermore, though in the shown embodiment the mixture ratio of ore to coke is changed with respect to predetermined mixture rates of mixtures, it may possible to sequentially vary the mixture ratio of the ore to coke. In such a case, the coke ratio may be gradually increased radially inward toward the center of the furnace.

What is claimed is:

1. A system for performing smelting operations comprising:

first means for supplying ore and coke for preparing a pre-mixture to charge in a shaft furnace;

second means for charging the pre-mixture of said ore and coke to said shaft furnace, said second means including a single chute to distribute the pre-mixture over varying radial cross-sections of said furnace;

third means for introducing a heating gas through tuyeres for heating the burden in said shaft furnace for obtaining molten pig metal; and fourth means for adjusting the mixture ratio of said ore and coke so that the ore/coke mixture ratio in the central portion of the furnace is different from that in the circumferential portion of the furnace.

2. A system as set forth in claim 1, wherein said first means comprises means for adjusting said ore/coke mixture ratios in said central portion and said circumferential portion so as to provide lower gas flow resistance for greater gas flow amount at the central portion of the furnace in comparison with that in the circumferential portion.

3. A system as set forth in claim 2, wherein said first means also comprises means for adjusting the ore/coke ratios so as to provide greater gas flow amount in the portion adjacent a furnace wall than that in the remainder of said circumferential portion.

4. A system as set forth in claim 3, which further comprises fifth means for monitoring gas flow distribution over the radial positions in the furnace and said first means is controlled operation on the bias of the monitored gas distribution for adjusting said ore/coke ratios in said central portion and said circumferential portion to maintain the gas flow distribution at a predetermined pattern.

5. A system as set forth in claim 4, wherein said second means comprises means operative for adjusting the areas to distribute said different ore/coke ratios of mixtures.

6. A system as set forth in claim 5, wherein said second means comprises means performing adjustments of the mixtures distribution areas for minimizing the area around the center, of the furnace where the mixture providing lower gas flow resistance is charged with maintaining the necessary gas flow amount required for effectively performing smelting operations.

7. A system as set forth in claim 6, wherein said second means also comprises means for performing adjustment of the mixtures distribution areas for providing lower gas flow resistance in the region adjacent a furnace wall than that of remainders in the circumferential portion.

8. A system for performing smelting operations comprising:

a chute for distributing burdens to be charged to a shaft furnace, said chute being rotatable about a horizontal axis extending through an upper portion of said furnace;

first mixture supply means for preparing a first mixture of ore and coke to charge in a shaft furnace, which first mixture provides a first gas flow efficiency for a heating gas as charged into said shaft furnace;

second mixture supply means for preparing a second mixture of ore and coke to charge in a shaft furnace, which second mixture provides a second gas flow efficiency for the heating gas charged into said shaft furnace, which second gas flow efficiency is lower than said first gas flow efficiency;

third mixture charge means for charging said first mixture of said ore and coke in cooperation with said chute to the central portion of said shaft furnace; and fourth mixture charge, means for charging said second mixture of said ore and coke in cooperation with said chute to the circumferential portion of said shaft furnace.

9. A system as set forth in claim 8, wherein said third and fourth means distributes said first mixture in a first position in said central portion and said second mixture in a second position in said circumferential portion so as to maintain gas flow pattern over radially oriented various positions in the furnace in conformance with a predetermined distribution pattern.

10. A system as set forth in claim 8, wherein said third and fourth means distributes said first mixture in a first position in said central portion and said second mixture in a second position in said circumferential portion so as to provide predetermined gas flow efficiency at the center of the furnace, which predetermined gas flow efficiency at the center of the furnace is higher than that of the remainder and is determined for providing enough heat level and stable burden desending necessary for smelting operation.

11. The system as set forth in claim 29, further comprising means for determining said predetermined gas flow efficiency in the center of the furnace at a possible minimum value for providing possible minimum heat value which is enough to effectively perform smelting operation.

12. A system as set forth in claim 11, which further comprises fifth means for monitoring gas flow distribution in the furnace during smelting operations and producing gas flow distribution indicative signals and sixth means for receiving said gas flow distribution indicative signals for detecting gas flow pattern, comparing the detecting gas flow pattern with said gas flow pattern, deriving radial positions to distribute said first and second mixtures, and outputting distribution control signals for said third and fourth means for radially adjusting said first and second positions to charge said first and second mixtures for maintaining the gas flow pattern in conformance with said predetermined pattern.

13. A system as set forth in claim 12, wherein said sixth means also derives distribution of said first and second mixture is so adjusted as to provide higher gas flow efficiency for the portion adjacent the furnace wall than that in the general portion, which gas flow efficiency in the portion against the furnace wall is determined to be sufficient for preventing melt from adhering onto the furnace wall.

14. A system as set forth in claim 13, wherein said first and second mixture supply means comprises means operative for adjusting gas flow efficiencies of said first and second mixtures, and said sixth means comprises mens operative for determining ore/coke mixture ratios on the basis of said gas flow distribution indicative signal to produce mixture control signal to control operations of saiid first and second mixture supply means for adjusting the mixture rate of coke versus ore, in which said sixth means operates said first mixture supply means for preparing said first mixture having a coke ratio versus ore higher than that in the second mixture.

15. A system as set forth claim 14, wherein said coke ratio in said first mixture is 100%.

* * * * *

UNITED STATES PATENT AND TRADEMARK OFFICE

CERTIFICATE OF CORRECTION

PATENT NO. : 4,913,406

DATED : 4/3/90

INVENTOR(S) : Norio Fukushima, Yasunori Serizawa, Kazuhiko Yoshida, Shigeyasu Suzuki, Masanobu Masukawa, Shoji Sakurai It is certified that error appears in the above-identified patent and that said Letters Patent is hereby corrected as shown below:

Column 1, line 58, after "have" insert --been--;

line 59, change "has" to --gas--;

line 60, delete "been";

line 60, change "path" to --paths--.

Column 13, line 34, change "bias" to --basis--.

Column 14, line 28, change "29" to --10--.

Signed and Sealed this

Ninth Day of April, 1991

*Attest:*

HARRY F. MANBECK, JR.

*Attesting Officer*

*Commissioner of Patents and Trademarks*